United States Patent [19]

Valori et al.

[11] Patent Number: 4,486,940

[45] Date of Patent: Dec. 11, 1984

[54] METHOD OF FORMING A SEWING MACHINE HOOK ASSEMBLY

[75] Inventors: Giuseppe Valori, Monza; Marco Primati, Cinisello Balsamo, both of Italy; Victor G. Stevens, Westfield, N.J.

[73] Assignee: The Singer Company, Stamford, Conn.

[21] Appl. No.: 442,540

[22] Filed: Nov. 18, 1982

[51] Int. Cl.[3] ..... B21D 39/00; B23P 11/00

[52] U.S. Cl. ..... 29/509; 29/522 A; 29/DIG. 24; 112/228; 403/274

[58] Field of Search ..... 29/522 R, 509, 522 A, 29/243.54, DIG. 24; 112/228; 403/274

[56] References Cited

U.S. PATENT DOCUMENTS

| | | | |
|---|---|---|---|
| 2,805,588 | 9/1957 | Sterling | 29/522 R UX |
| 3,955,519 | 5/1976 | Weisz | 112/228 |
| 3,999,274 | 12/1976 | Butler | 29/509 X |
| 4,284,017 | 8/1981 | Starr | 112/228 X |
| 4,404,995 | 9/1983 | Bowen et al. | 29/522 R X |

*Primary Examiner*—Charlie T. Moon

*Attorney, Agent, or Firm*—Robert E. Smith; Edward L. Bell

[57] ABSTRACT

A method is disclosed for fabricating and assembling a sewing machine hook shaft and hook body by which the required critically accurate shapes may be attained in a particularly cost effective manner.

2 Claims, 4 Drawing Figures

Fig.1
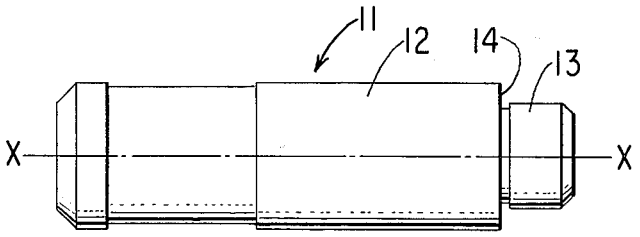
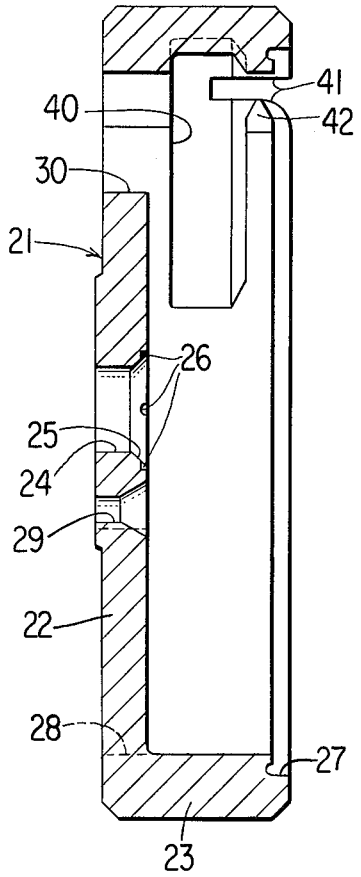
Fig.2
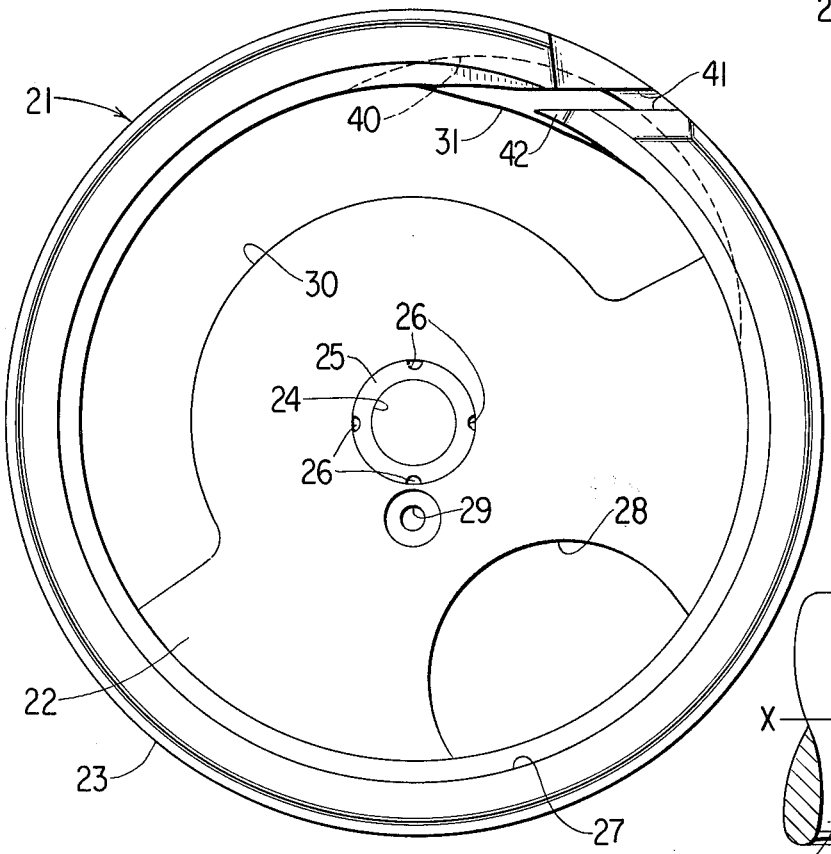
Fig.3
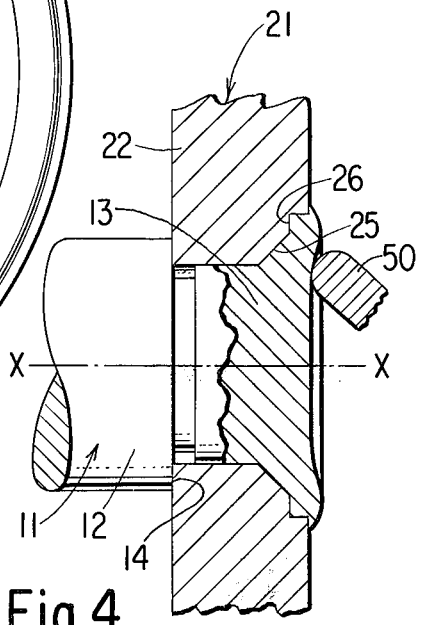
Fig.4

METHOD OF FORMING A SEWING MACHINE HOOK ASSEMBLY

DESCRIPTION

Field of the Invention

This invention relates to the art of manufacture of sewing machine stitch forming instrumentalities, and more particularly, to novel and highly cost effective methods of manufacturing sewing machine rotary hook and hook shaft assemblies.

BACKGROUND OF THE INVENTION

Known methods of manufacturing sewing machine hooks have required either a relatively large number of successive critical machining operations to an integral blank, or the assembly of separately machined parts of the hook such as a gib, hook beak, raceway elements, needle guards, thread cams and the like. Moreover, in the prior art, essentially the same type of base metal was usually employed for the hook body parts as for the hooks shaft so that the two might be made integrally or united by welding and heat treated together without adverse effect one on the other.

OBJECTS OF THE INVENTION

It is an object of this invention to provide a novel method of manufacturing a sewing machine hook in which the required critically accurate surfaces may be attained in a particularly cost effective manner without most of the machining operations which were heretofore considered necessary. It is also an object of this invention to provide a novel and effective mode of assembling the hook body and hook shaft which does not damage, distort or otherwise adversely affect the hook body which is made in accordance with the highly cost effective techniques of this invention.

SUMMARY OF THE INVENTION

The objects and advantages of this invention are attained by a method of forming a sewing machine hook and hook shaft assembly in which the hook body and hook shaft are fabricated separately; the hook body being made by a powdered metal sintering process; in which the hook body and hook shaft are separately heat treated during which the portion of the hook shaft destined to be fastened to the hook body is left substantially unhardened; and in which a novel mode for achieving the fastening of the hook body and hook shaft is employed which does not distort or damage the sintered hook body portion.

DESCRIPTION OF THE DRAWING

This invention will be understood from the following detailed description when taken in conjunction with the annexed drawing, which illustrates a preferred embodiment of this invention, in which:

FIG. 1 is an elevational view of a sewing machine hook shaft made in accordance with this invention;

FIG. 2 is a cross sectional view of a sewing machine hook body portion made in accordance with this invention;

FIG. 3 is a top plan view of the sewing machine hook body portion of FIG. 2, and FIG. 4 is an enlarged cross sectional view of portions of the assembled hook body portion and hook shaft including representation of a fragment of a orbital riveting tool illustrating the arrangement of elements during the step of joining the hook body and the hook shaft.

DETAILED DESCRIPTION OF THE INVENTION

Referring to the drawings, FIG. 1 illustrates a rotary hook shaft 11 as it is manufactured in accordance with this invention independently of other portions of the sewing machine rotary hook assembly. FIGS. 2 and 3 illustrate a sewing machine hook portion 21 as it is manufactured in accordance with this invention independently of the hook shaft 11.

Referring to FIGS. 2 and 3, a hook body portion 21 is disclosed which is especially designed to facilitate its manufacture by a powdered metal sintering process. In such a sintering process, the metal power is introduced into a mold cavity where it is compressed to such a degree that the power is integrated temporarily into a dimensionally unified unit referred to as a "green compact". The mold configuration must permit extraction of the unified green compact therefrom and thus an absence of undercuts and perpendicularly arranged irregularities is required. The green compact subsequent to removal from the mold is heat treated in a sintering process during which weld-like bonds are created between the compacted power metal particles so that the unified shape of the green compact is transformed into a stable permanently unified article.

As shown in FIGS. 2 and 3, the hook body portion 21 is formed with a base 22 from which an annular rim 23 extends. The base 22 is formed with a cylinderical opening 24 which is flared as at 25 and a plurality of irregularities in the form of indentations 26 are formed in the flared portion 25 of the opening 24. The free extremity of the rim 23 is preferably formed with an annular recess 27 and the base 22 of the hook body may be formed with a plurality of apertures 28, 29 and 30. The aperture 28 may serve to locate center of gravity of the hook body portion about the axis of the cylindrical opening 24, the aperture 29 may serve as a lubricant conducting port, and the aperture 30 provides clearance for passage of a sewing machine needle and may be further formed with an irregularity 31 along one side serving as a guide to influence precise location of a sewing machine needle during sewing machine operation.

Preferably, the hook body portion 21 as it is sintered is formed with a continuous unbroken rim 23 which after sintering is subjected to two machining operations, the first providing a circularly shaped undercut 40 inside the rim and the second providing a straight slot 41 skewed relatively to the axis of the cylindrical opening 24 to define a hook beak 42.

Referring to FIG. 1, the hook shaft 11 preferably comprises a unit machined from plain cylindrical stock and including a central cylindrical bearing portion 12 and an extremity 13 of smaller diameter than the bearing portion so as to be separated therefrom by a shoulder 14.

In accordance with this invention, the hook shaft 11 and the hook body portion 21 after fabrication may be separately heat treated and hardened. The heat treating temperatures, quenching conditions, and the like may thus be chosen for each part without consideration as to any possible bad effect upon the other part.

In heat treating the hook shaft 11, care is taken not only to minimize the temperature to which the extremity 13 is raised, but also to avoid quenching the extremity so that while the bearing portion 12 may be case hardened to provide an appropriate bearing surface thereon, the extremity 13 will be maintained in an annealed, relatively malleable condition.

With reference to FIG. 4, the final step in the assembly of the hook shaft 11 and hook body portion 21 in accordance with this invention will now be described. The shaft extremity 13, after insertion into the cylindrical opening 24 of the hook body is maintained with the shoulder 14 against the base 22 of the hook body 21 and the free extremity 13 is subjected to deformation by an orbital rivet setting operation.

Essentially, orbital rivet setting comprises the process of subjecting the free shaft extremity to a series of repeated blows by a small reciprocatory impact tool head 50 which is slightly inclined with respect to the axis X—X of the hook shaft 11, while the hook shaft and hook body portion are slowly rotated about the axis X—X.

As a result, the malleable shaft extremity 13 is deformed, as illustrated in FIG. 4, and caused to flow into the flared portion 25 of the cylindrical opening 24 and into the plurality of indentations 26 therein. The presence of the hook shaft material in the flared portion 25 prevents axis separation of the hook body portion from the hook shaft, and presence of the hook shaft material in the indentations 26 locks the hook body for rotation with the hook shaft. Because of such interlocking relationship both axially and angularly between the parts which the configuration and orbital riveting provides, abnormally high compressive forces are not required in order to provide the requisite interlocking between these parts. As a result, the danger of damaging or distorting the hook body portion by this joining process is minimized, and the accurate critical shape of the hook body portion attained by the powdered metal sintering process is not disturbed by the assembly or joining steps.

This invention thus provides a method for providing extremely accurate and uniform sewing machine hook assemblies in particularly cost effective manner.

We claim:

1. The method of forming a sewing machine rotary hook and hook shaft assembly comprising:

machining a hook shaft with a shouldered extremity, forming a hook body by a powdered metal sintering process, said hook body including a flared seat from accomodating said shouldered shaft extremity, separately heat treating to harden said sintered hook body and said machined hook shaft maintaining said shouldered hook shaft extremity in substantially unhardened condition, assembling said hook shaft shouldered extremity within the flared seat of said hook body, and deforming said shouldered extremity of said hook shaft into gripping relation within the flared seat of said hook body by an orbital rivet setting process.

2. The method of forming a sewing machine rotary hook and hook shaft assembly as set forth in claim 1 including the further steps of:

forming irregularities in the flared seat of said hook body during said sintering process, and deforming said shouldered extremity of said hook shaft into mating relation in said irregularities during said orbital rivet setting process.

* * * * *